US006241251B1

(12) United States Patent
Trifonov

(10) Patent No.: US 6,241,251 B1
(45) Date of Patent: Jun. 5, 2001

(54) BEACH GAME

(76) Inventor: Plamen Trifonov, 9770 Richmond Cir., Boca Raton, FL (US) 33434

( * ) Notice: Subject to any disclaimer, the term of this patent is extended or adjusted under 35 U.S.C. 154(b) by 0 days.

(21) Appl. No.: 09/352,312

(22) Filed: Jul. 12, 1999

(51) Int. Cl.[7] ..... A63B 67/06
(52) U.S. Cl. ..... 273/339
(58) Field of Search ..... 273/336, 337, 273/338, 339, 317, 332, 386, 393, 407, 287, 317.1, 440, 354, 126 R, 118 R, 348; 473/490

(56) References Cited

U.S. PATENT DOCUMENTS

| | | | | |
|---|---|---|---|---|
| 145,914 | * | 12/1873 | Smith | 273/338 |
| 519,324 | * | 5/1894 | Davids | 273/337 |
| 956,244 | * | 4/1910 | Westerberg | 273/317 |
| 2,923,548 | * | 2/1960 | Kappel | 273/386 |
| 4,180,266 | * | 12/1979 | Morin et al. | 273/338 |
| 4,198,048 | * | 4/1980 | Rathert | 273/339 |
| 4,330,130 | * | 5/1982 | Carr | 273/407 |
| 4,386,779 | * | 6/1983 | Whitlock | 273/336 |
| 4,593,912 | * | 6/1986 | Rivas et al. | 273/339 |
| 4,940,242 | * | 7/1990 | Tingley | 273/287 |
| 4,966,373 | * | 10/1990 | Houle et al. | 273/339 |
| 5,533,735 | * | 7/1996 | Denney | 273/348 X |
| 5,741,194 | * | 4/1998 | Simunek | 473/490 |

* cited by examiner

*Primary Examiner*—Raleigh W. Chiu
(74) *Attorney, Agent, or Firm*—Robert M. Downey, P.A.

(57) ABSTRACT

A game of skill to be played between two or more players on sand or other soft terrain, wherein each player is provided with a set of stakes and a boundary marking device. The stakes each having a head portion, an elongate body, and a lower portion including a tapered bottom end zone structured to be driven into the sand so that the stakes are held in an upright position. Each player's boundary marking device is placed upon the sand and formed into a closed configuration so as to surround an interior area defining the player's territory or camp. In a preferred embodiment, a war game is simulated, wherein each player's stakes represent soldiers. One of the stakes in each player's set is shorter, representing a general. With each of the player's camps spaced a predetermined distance apart, the player's stakes are selectively placed within their territories in a manner which is intended to protect that player's general. During play, each of the players takes a turn tossing an assault ring in an attempt to capture or destroy the other player's soldiers and general by landing the assault ring around the other player's stakes, or by knocking the stakes over beyond 45 degrees from the vertical position. A player wins by successfully capturing the other player(s) general or by capturing and/or destroying all of the other player(s) soldiers.

1 Claim, 4 Drawing Sheets

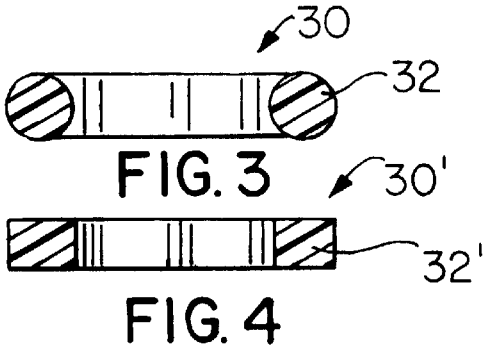
FIG. 3
FIG. 4
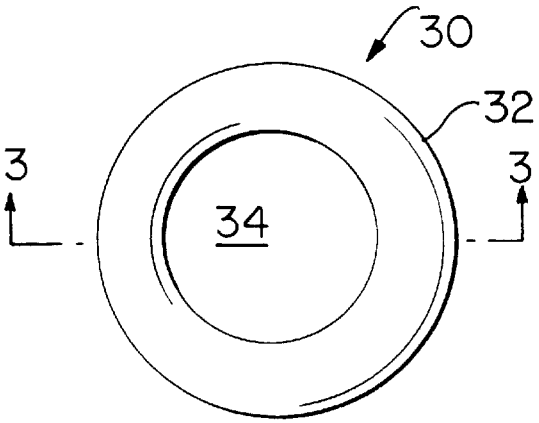
FIG. 2
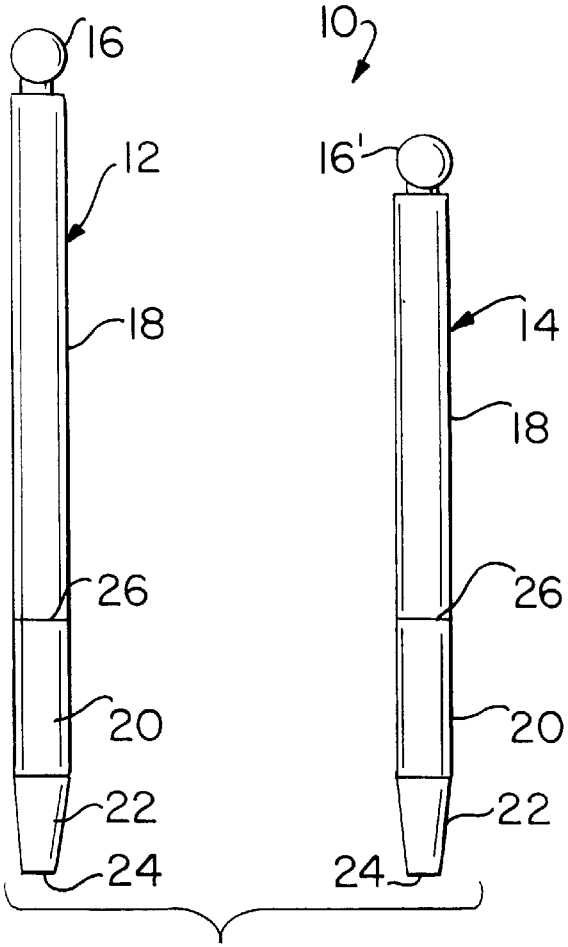
FIG. 1

BEACH GAME

BACKGROUND OF THE INVENTION

1. Field of the Invention

The present invention relates to a game to be played on the sand, and more particularly, to a beach game to be played between two or more players, wherein each player is provided with a plurality of stakes and a boundary marking device. Each player places his/her stakes within their territory, as defined by the boundary marking device, and the players take turns tossing a ring in an attempt to remove and/or capture the other player's stakes by knocking the stakes over or landing the ring around the other player's stakes.

2. Background of the Invention

Through the years, there have been many outdoor games for play between two or more persons. Of particular significance to the present invention are games which involve tossing an object with a degree of accuracy, towards another player's territory, wherein the degree of accuracy of the toss accumulates points, another player's pieces, or another type of value. The object of these games is to be the first to reach a predetermined value, or to collect one or more of the other player's key playing pieces.

The most well known game of this type is horseshoes, wherein players are spaced apart, a predetermined distance, and each player tosses a horseshoe towards a post in the other player's territory. Points are accumulated based on the degree of accuracy of the toss, wherein the object is to land the horseshoe in surrounding relation to the post.

While horseshoes and other games of this nature are well known and have been in existence for many years, there still exists a need for a game of skill which is particularly suited for play at the beach and which incorporates both the element of accuracy in tossing an object, such as a ring, with the element of strategy, much like the game of chess. More specifically, there is a need for a simulated war game, which is specifically designed to be played on the sand, and wherein each of the players is provided with a plurality of playing pieces (soldiers and a general) wherein the object is to capture the other player's soldiers and general.

SUMMARY OF THE INVENTION

The present invention is directed to a game of skill to be played between two or more players on sand or other soft terrain, wherein each player is provided a predetermined number of stakes each having a head portion, an elongate body, and a lower portion including a tapered bottom end zone structured to be driven into the sand so that the stakes are held in an upright position. Each of the players is further provided with a boundary marking device which is placed upon the sand and formed into a closed configuration so as to surround an interior area defining the player's territory. In a preferred embodiment, a war game is simulated, wherein a player's stakes represent soldiers. One of the stakes is shorter, representing a general. With each of the player's territories spaced a predetermined distance apart, the player's stakes are selectively placed within their territories and each of the players takes a turn tossing a ring in an attempt to capture the other player's soldiers and general by landing the ring around one or more stakes, or knocking the stakes over. A player wins by successfully capturing or killing the other player(s) general.

Accordingly, with the foregoing in mind, it is a primary object of the present invention to provide a game of skill which can be played at the beach, which incorporates the elements of accuracy and strategy.

It is still a further object of the present invention to provide a game of skill which can be played on the sand, such as at the beach, which can be played by people of all ages.

It is still a further object of the present invention to provide a game of skill which is easy to transport and set up for play at the beach, park or other area where there is sand or like soft terrain.

It is yet a further object of the present invention to provide a game of skill which is particularly adapted for play outdoors and which is easy to comprehend and play by people of all ages.

It is still a further object of the present invention to provide an outdoor skill game which is easy to manufacture, at a low cost, thereby making it affordable to the average consumer.

It is yet a further object of the present invention to provide an outdoor skill game which is safe, challenging and fun to play by people of all ages.

These and other objects of the present invention will be more readily apparent with reference to the following description and drawings.

BRIEF DESCRIPTION OF THE DRAWINGS

For a fuller understanding of the nature of the present invention, reference should be made to the following detailed description taken in conjunction with the accompanying drawings in which:

FIG. 1 is an elevational view of two stakes which make up part of the components of the game of the present invention, and wherein a taller one of the stakes represents a soldier and the shorter stake represents a general;

FIG. 2 is a top plan view of a ring which is used in the play of the game of the present invention;

FIG. 3 is a cross sectional view taken along the line 3—3 of FIG. 2;

FIG. 4 is a cross sectional view of another embodiment of the ring shown in FIG. 2;

Like reference numerals refer to like parts throughout the several views of the drawings.

DETAILED DESCRIPTION OF THE PREFERRED EMBODIMENTS

Figure 5:
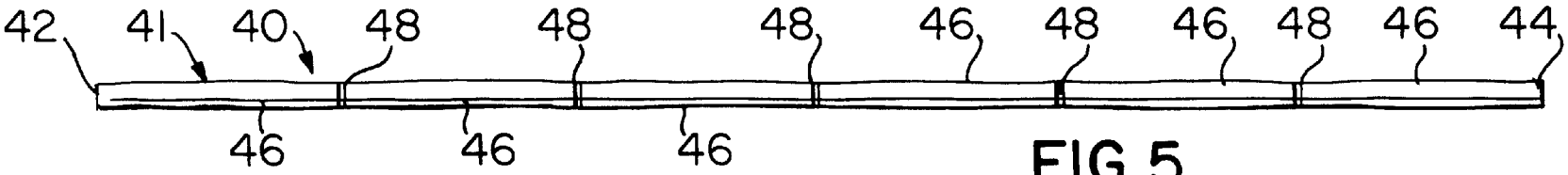
FIG. 5 is a side elevational view of an elongate rope for use as a boundary marking device in accordance with one embodiment of the present invention.
Figure 6:
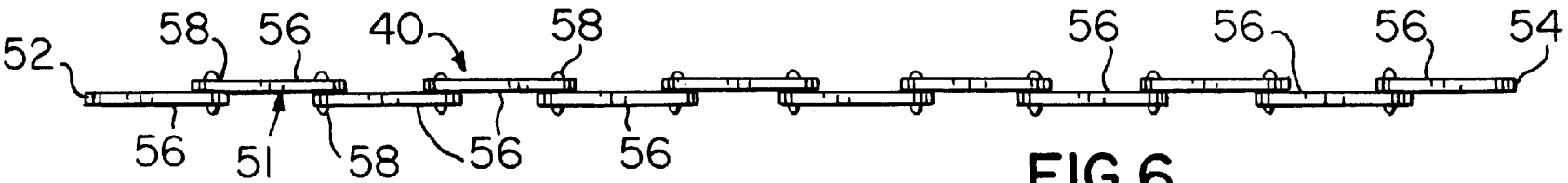
FIG. 6 is a side elevational view of another boundary marking device comprising individual segments which are pivotally connected to one another, in accordance with another embodiment of the present invention.

Referring to the several views of the drawings, the several components of the skill game are shown. Referring initially to FIG. 1, each player is provided with a plurality of stakes, generally indicated as 10, including a plurality of taller stakes 12 and one stake 14 which is shorter than the other stakes. In the preferred embodiment, the game simulates a war or battle involving soldiers. In this instance, the taller stakes 12 of each player represents soldiers and the shorter stake 14 represents a general in command of the soldiers. As best illustrated in FIG. 1, the soldier stakes 12 are further identified by a head portion 16 and the general stake 14 is identified by a head portion 16'. The head 16' of the general stake 14 may be of a different configuration than the head 16 of the soldier stakes 12. Alternatively, the general's head 16' may be of a different color than the head 16 of the soldiers 12. In yet another embodiment, the entire general stake 14, including the head 16', may be of a different color than the entire soldier stakes 12.

The general stake 14 and each of the soldier stakes 12, for each player, are further defined by an elongate body 18 extending down from the head 16', 16, respectively, to a lower portion 20. The lower portion 20 of each of the stakes 12, 14 includes a bottom end zone 22 which is tapered towards a bottom end 24. The tapered configuration of the bottom end zone 22 is specifically structured to permit driving of the stakes 12, 14 into a soft terrain, such as the sand on a beach. The stakes 12, 14 may be provided with a marking line 26 which indicates a maximum depth to which the stakes are to be driven into the sands. Thus, when the stakes are positioned within the sand, as explained more fully hereinafter, the top surface of the sand should not be above the line 26. In the preferred embodiment, the taller stakes, representing the soldiers, are 12 inches in height, while the shorter stakes 14 representing the general for each player, are 8 inches in height.

The game further comprises a ring 30 having an annular body 32 surrounding a central opening 34. In one embodiment, the annular body 32 may have a round cross sectional configuration, as shown in FIG. 3. In another embodiment shown in FIG. 4, the ring 30' is provided with an annular body 32' having a square or rectangular cross sectional configuration. In either of the embodiments shown in FIGS. 3 or 4, the rings 30, 30' surround the central opening 34 which is specifically sized in accordance with a predetermined diameter. In a preferred embodiment, the diameter of the central opening is 7 inches and the overall outer diameter of the annular body is 8 inches.

Referring to FIGS. 5–9, several embodiments of a boundary marking device 40 are shown. Referring initially to FIG. 5, a first boundary marking device 41 is in the form of a flexible rope or chord having a first end 42 and an opposite end 44. The rope 41 is divided into segments 46 as defined by markings 48 at equi spaced intervals along the length of the rope 41 between the opposite ends 42, 44. In a preferred embodiment, the length of each segment 46 is 2 feet. Accordingly, the overall length of the rope 41 is 12 feet.

In another embodiment of the boundary marking device 40, a folding multi segmented structure 51 is provided extending between opposite ends 52 and 54. The folding structure 51 comprises a plurality of rigid elongate segments 56 which are hinged together, at opposite ends by hinge means 58. The hinge means may comprise pins, rivets, or other well known fastening devices which permit pivotal, swinging movement of two flat, ruler-like segmented components relative to one another. In a preferred embodiment, there are 12 segments 56, each having a length of approximately 12 inches. Accordingly, the overall length of the boundary marking device 51, between the opposite ends 52 and 54 measures approximately 12 feet.

Figure 7:
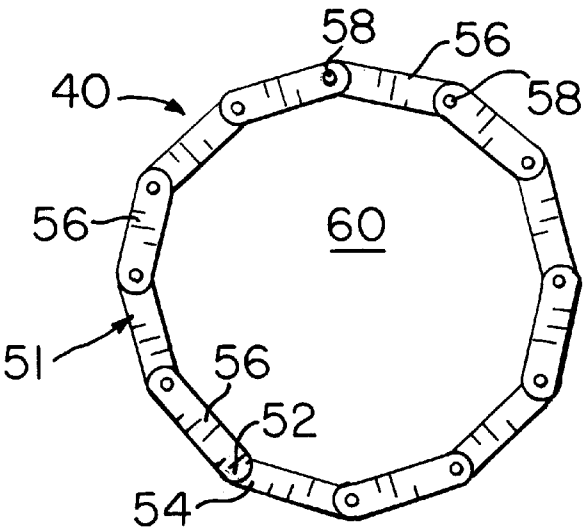
FIG. 7 is a top plan view showing the boundary marking device of FIG. 6 positioned in a generally circular configuration to surround an area defining a player's territory.
Figure 9:
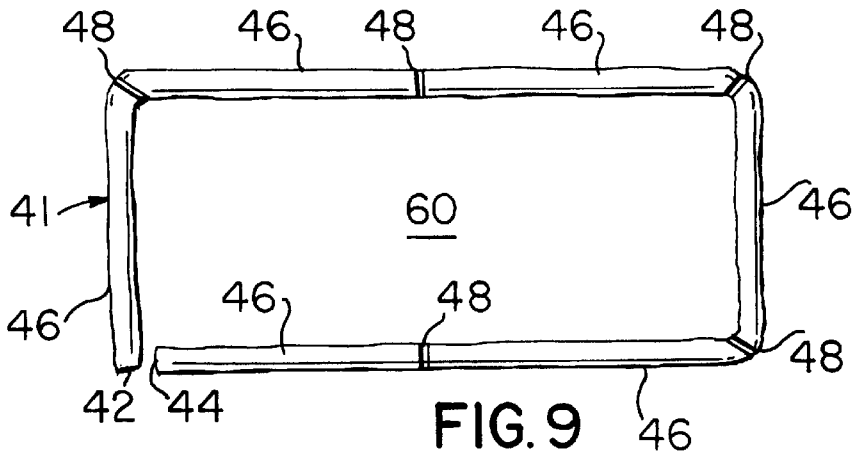
FIG. 9 is a top plan view showing the boundary marking device of FIG. 5 formed in yet another configuration (rectangular), to surround a player's territory.
Figure 8:
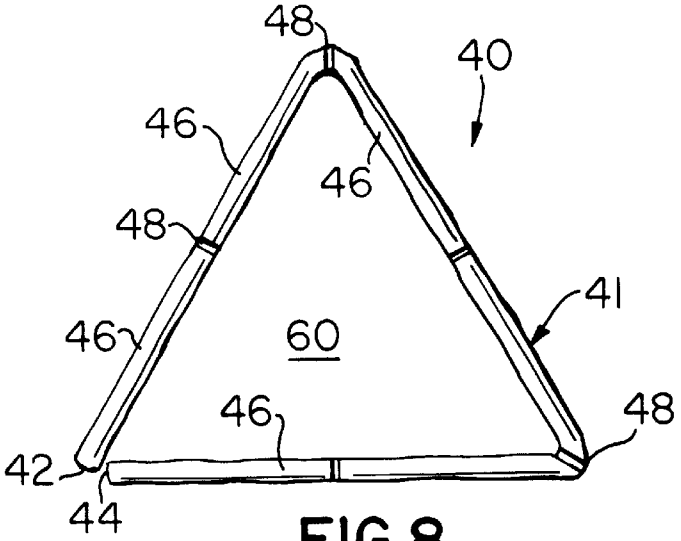
FIG. 8 is a top plan view showing the boundary marking device of FIG. 5 formed in a triangular configuration to define a player's territory therein.

As seen in FIG. 7, the boundary marking device 51 can be positioned into a closed configuration, such as a circle, so that the ends 52, 54 are brought together in surrounding relation to a central area 60 defining a player's territory. Other configurations, such as a square, triangle or rectangle can be achieved with the device 51. As seen in FIGS. 8 and 9, the rope boundary marking device 41 can also be positioned in accordance with various configurations with the ends 42 and 44 meeting one another, so that the rope boundary marking device 41 surrounds a central area 60, also defining the player's territory.

Figure 10:
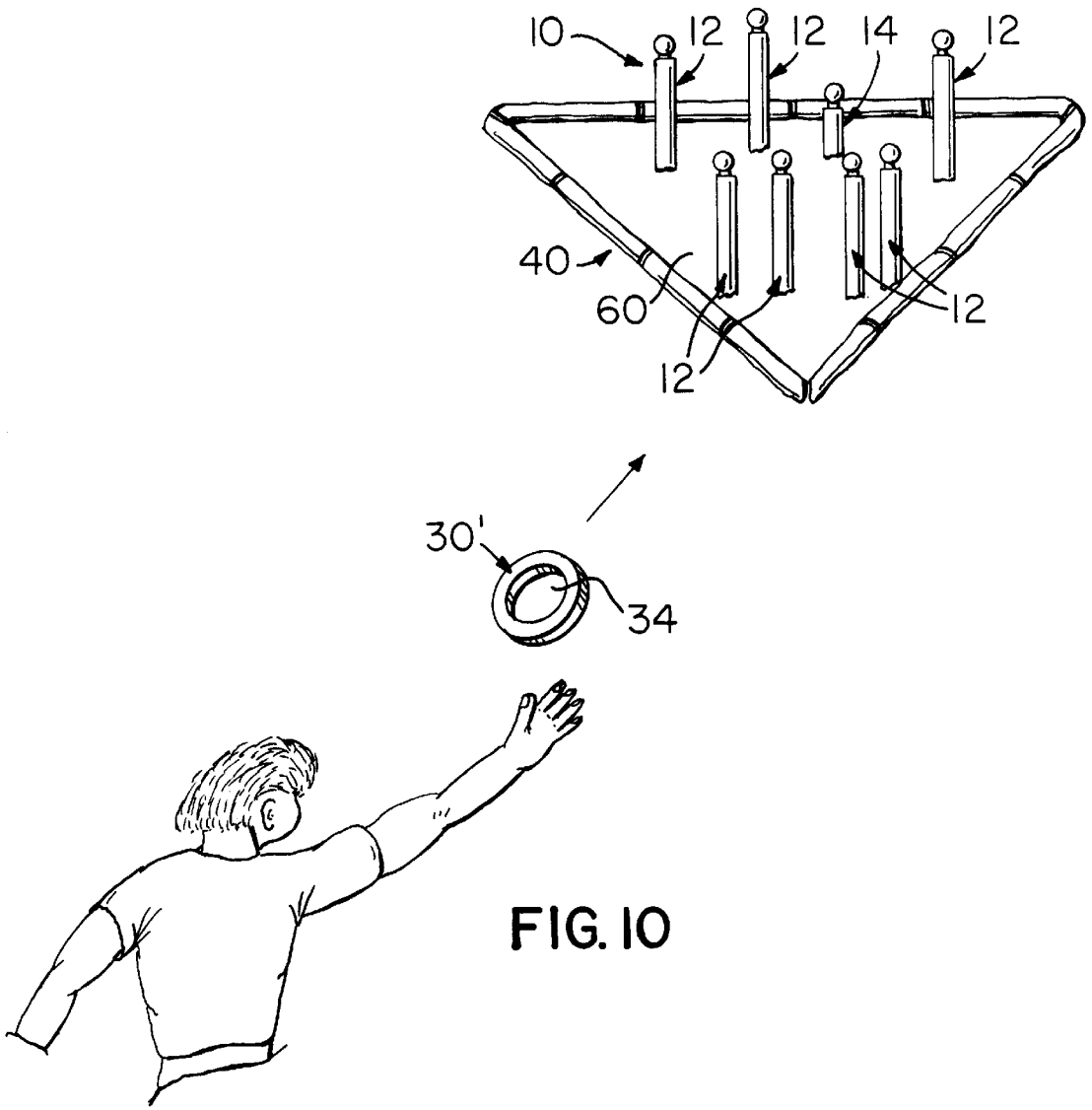
FIG. 10 is a perspective view showing a player tossing the ring towards another player's territory during the course of play of the game of the present invention.

As seen in FIG. 10, a player's stakes are positioned within the territory 60 by driving the stakes up to the maximum distance permitted (as discussed above) so that the stakes are in a generally upright position. The players territory are spaced a predetermined distance apart. Each player stands behind his/her territory and tosses the ring 30 or 30' towards the other player's territory 60 in an attempt to capture or destroy the other player's soldiers 12 and general 14, as discussed more fully hereinafter.

In a preferred embodiment, each player is provided with seven soldier stakes 12 and one general stake 14. After a distance between each player's territory 60 is agreed upon, each player places his/her boarder marking device 40 on the sand in a configuration which may be either selected by the player or agreed upon in advance. The boundary marking device, defining each player's territory, is positioned in accordance with the predetermined distance from the other player(s) territory. The distance between each player(s) territories may depend upon weather conditions and/or the experience of the player(s). Generally, the distance between each player's territory (camp) can be set anywhere from 5 to 20 feet apart.

After establishing the territories (camps), each player proceeds to position their soldiers and general within their respective territory. The positioning of the soldiers and general is entirely up to each player and, to a large extent, contributes to the overall strategy of the game. After gaining more experience in the play of the game, each player will develop a strategy and instinct as to how to best position the soldiers and general in a manner which uses the territory most effectively so that the general is protected from the other player(s).

During play, each player takes a turn tossing the ring 30, 30' towards another player's territory (camp) in an attempt to remove the enemies (other player's) soldiers and general. The enemies soldiers and general can be either destroyed or captured. Specifically, if a solider 12 is hit with the ring 30, 30' and tilted more than 45 degrees from the vertical position, that soldier is considered destroyed and is taken out of the game. On the other hand, if the ring 30, 30' is thrown over another player's soldier(s) and/or general, if the soldier/general is inside the ring, then the solider or general is considered captured. A captured soldier 12 is taken out of its position and is immediately "enlisted" into the troops of the other player who has captured that soldier. In this instance, the player who captured the soldier can now place that extra soldier anywhere within his/her own territory (camp).

The game proceeds until one of the player's generals is captured, or until all of a player's soldiers are destroyed. If a player's general is destroyed, the soldiers can still fight until all of that player's soldiers have been destroyed or captured. If all of a player's soldiers are destroyed, then a general is considered to be automatically captured and that player is then out of the game. If there are more than two players, the game proceeds until only one player is remaining; having successfully eliminated the other players by capturing their generals or destroying all of their soldiers.

Regardless of how many players are participating, the order of attacking is determined as follows. A soldier is placed about 10 feet from a line drawn in the sand. Each player (the order does not matter) tosses the assault ring 30, 30' from the line towards the soldier. The goal is to throw as close to the soldier as possible. The player closest to the target soldier goes first. The second closest, second, etc. If two players are tied for the same place, they must play out the tie in the same manner, after all of the players have thrown.

While the present invention has been shown and described in accordance with preferred and practical embodiments thereof, it is recognized that departures may be made from the instant disclosure which, therefore, should not be limited except as defined within the scope of the following claims as interpreted under the doctrine of equivalents.

Now that the invention has been described,

What is claimed is:

1. A method of playing a game of skill on the sand by two or more players, said method comprising the steps of:

providing a set of playing pieces to each of the players, wherein each of the playing pieces of the set include an elongate body, a head portion and a lower end zone, and the set of playing pieces further including a plurality of first playing pieces of equal length and a second playing piece having a length which is shorter than the plurality of first playing pieces;

providing each of the players with boundary marking means for enclosing an area on the sand to thereby define a territory for each of the players;

spacing the players' territories at a predetermined distance apart;

placing the first and second playing pieces of said set, for each player, within the respective player's territory by driving the lower end zone of each of said first and second playing pieces into the sand so as to maintain the playing pieces in an upright position;

taking turns, by each player, tossing a ring towards another player's territory;

attempting to capture another player's playing pieces by landing the ring over one or more of the other player's playing pieces so that the ring surrounds the one or more playing pieces of the other player, wherein the captured one or more playing pieces is removed from the other player's territory and placed in the territory of the player which captured the respective one or more playing pieces;

attempting to destroy another player's playing pieces by striking the other player's playing pieces and knocking one or more of the other player's playing pieces from the upright position to a tilted position beyond forty-five degrees from vertical wherein the destroyed playing pieces are removed from the other player's territory; and continuing to take turns tossing the ring, by each player, until only one player has said second playing piece of said set remaining within that player's territory.

* * * * *